US010297942B1

(12) United States Patent
Gauthier et al.

(10) Patent No.: US 10,297,942 B1
(45) Date of Patent: May 21, 2019

(54) GROUNDING CONNECTORS

(71) Applicant: AFL Telecommunications LLC, Duncan, SC (US)

(72) Inventors: John Gauthier, Taylors, SC (US); Kelvin Turner, Williamston, SC (US)

(73) Assignee: AFL Telecommunications LLC, Duncan, SC (US)

( * ) Notice: Subject to any disclaimer, the term of this patent is extended or adjusted under 35 U.S.C. 154(b) by 0 days.

(21) Appl. No.: 15/883,682

(22) Filed: Jan. 30, 2018

(51) Int. Cl.

| | |
|---|---|
| ***H01R 4/66*** | (2006.01) |
| ***H01R 13/28*** | (2006.01) |
| ***H01R 13/655*** | (2006.01) |
| ***H01R 25/14*** | (2006.01) |

(52) U.S. Cl.
CPC ..... *H01R 13/28* (2013.01); *H01R 13/655* (2013.01); *H01R 25/145* (2013.01)

(58) Field of Classification Search
CPC ..... H01R 4/64; H01R 4/643; H01R 12/57; H01R 13/6392
USPC ..... 439/92, 100, 83, 367
See application file for complete search history.

(56) References Cited

U.S. PATENT DOCUMENTS 1,278,785 A * 9/1918 Tailer ..... F16B 7/0433 174/94 S
3,088,761 A 5/1963 Myers
4,201,433 A * 5/1980 Caldwell ..... H01R 4/646 439/98
9,343,819 B2 5/2016 McGann et al.

FOREIGN PATENT DOCUMENTS

WO WO2015/057912 A1 4/2015

OTHER PUBLICATIONS

DMC Power.Com Next Generation Power Connections Grounding Connectors Above & Below Ground Brochure.

* cited by examiner

*Primary Examiner* — Phuong Chi T Nguyen
(74) *Attorney, Agent, or Firm* — Dority & Manning, P.A.

(57) ABSTRACT

A grounding connector connectable to first and second electrical conductors includes a first body member and a second body member, each of the first and second body members connectable together to form a plurality of passages therebetween. One of the first or second body members further includes one of a locking channel or a locking tab and the other of the first or second body members further includes the other of a locking channel or a locking tab. The locking tab is disposed in the locking channel when the first and second body members are assembled together.

17 Claims, 2 Drawing Sheets

GROUNDING CONNECTORS

FIELD

The present disclosure relates generally to grounding connectors which are connectable to electrical conductors, such as for use in a grounding grid.

BACKGROUND

Electrical power distribution system substations generally utilize grounding systems to ground the substation components and ensure reliable performance. The grounding system typically includes a buried grid of electrical conductors.

Grounding connectors are typically utilized to connect the electrical conductors together and provide connections between the substation and the grounding system. The grounding connectors are generally crimped or swaged to one or more electrical conductors to provide such connections. Ground connectors come in a variety of different shapes and sizes to accommodate various different connection and size requirements.

One issue with some known ground connectors, however, is the number of separate components of the ground connectors that are required to be assembled before crimping, swaging, etc. For example, some known "split parallel" type ground connectors utilize a body and two separate caps. Electrical conductors are inserted into channels in the body. Each cap must then be inserted into a slot in the body to secure an associated electrical conductor between the cap and body. This installation process is relatively difficult, time consuming, and burdensome, because the installer has to manually secure the electrical conductors in the body while simultaneously attempting to insert the caps. Further, the low visibility environment in which such ground connectors are typically installed results in difficulty in finding such components in the event they are dropped.

Accordingly, improved ground connectors are desired.

BRIEF DESCRIPTION

Aspects and advantages of the invention will be set forth in part in the following description, or may be obvious from the description, or may be learned through practice of the invention.

In accordance with one embodiment, a grounding connector connectable to first and second electrical conductors is provided. The grounding connector includes a first body member and a second body member, each of the first and second body members defining a plurality of troughs, each of the first and second body members further including a locking channel and a locking tab. Mating troughs of the first and second body members together form passages which extend through the grounding connector when the first and second body members are assembled together. The locking tab of the first body member is disposed in the locking channel of the second body member and the locking tab of the second body member is disposed in the locking channel of the first body member when the first and second body members are assembled together.

In accordance with another embodiment, a grounding connector connectable to first and second electrical conductors is provided. The grounding connector includes a first body member and a second body member, each of the first and second body members connectable together to form a plurality of passages therebetween. One of the first or second body members further includes one of a locking channel or a locking tab and the other of the first or second body members further includes the other of a locking channel or a locking tab. The locking tab is disposed in the locking channel when the first and second body members are assembled together.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION

A full and enabling disclosure of the present invention, including the best mode thereof, directed to one of ordinary skill in the art, is set forth in the specification, which makes reference to the appended figures, in which.

DETAILED DESCRIPTION

Figure 1:
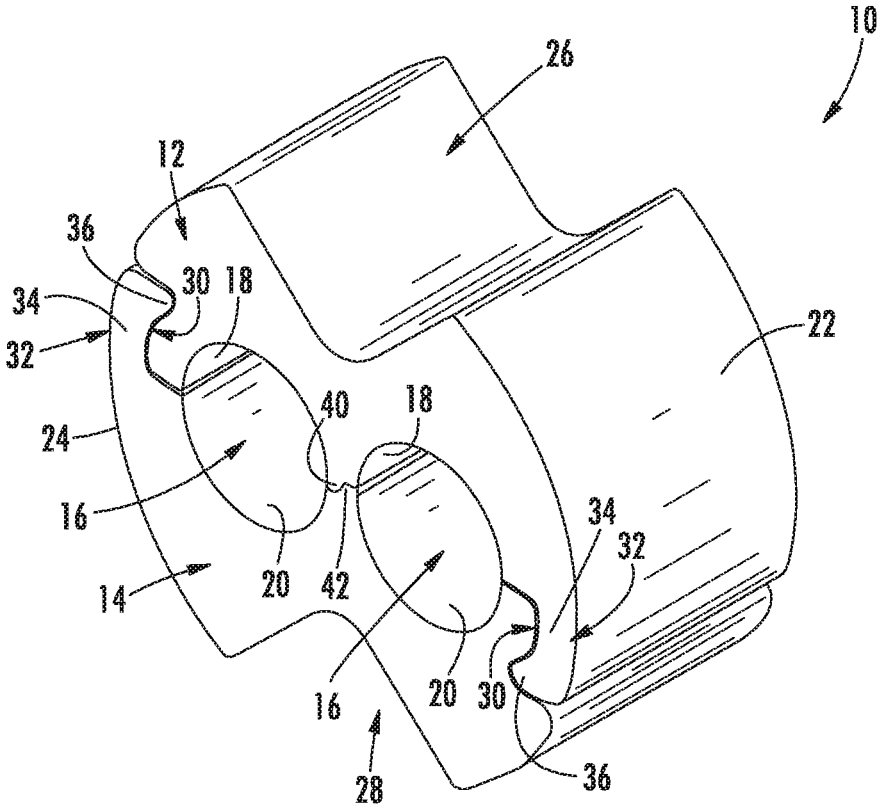
FIG. 1 is a perspective view of a grounding connector in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
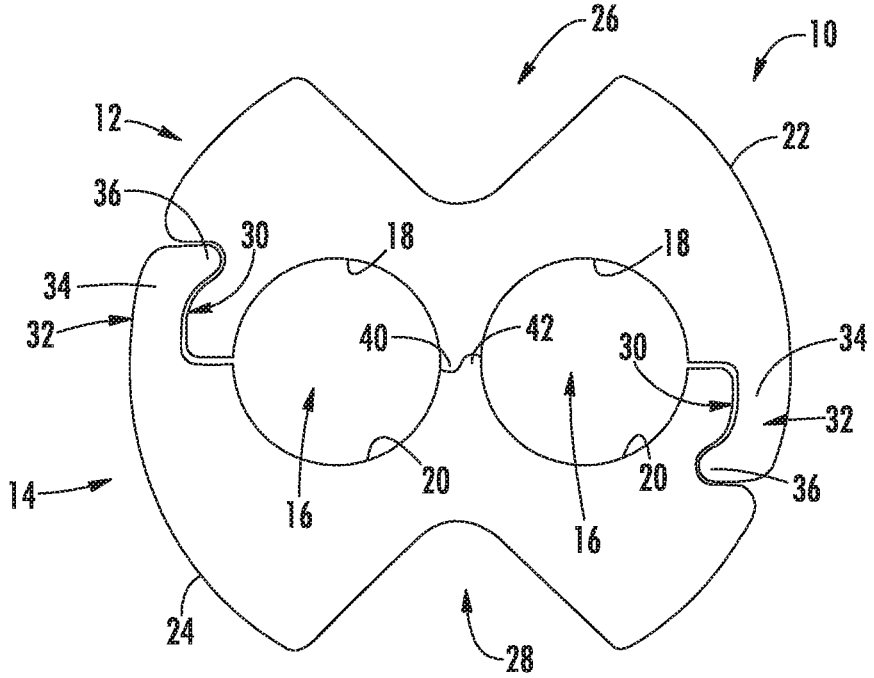
FIG. 2 is a front view of a grounding connector in accordance with embodiments of the present disclosure.
Figure 3:
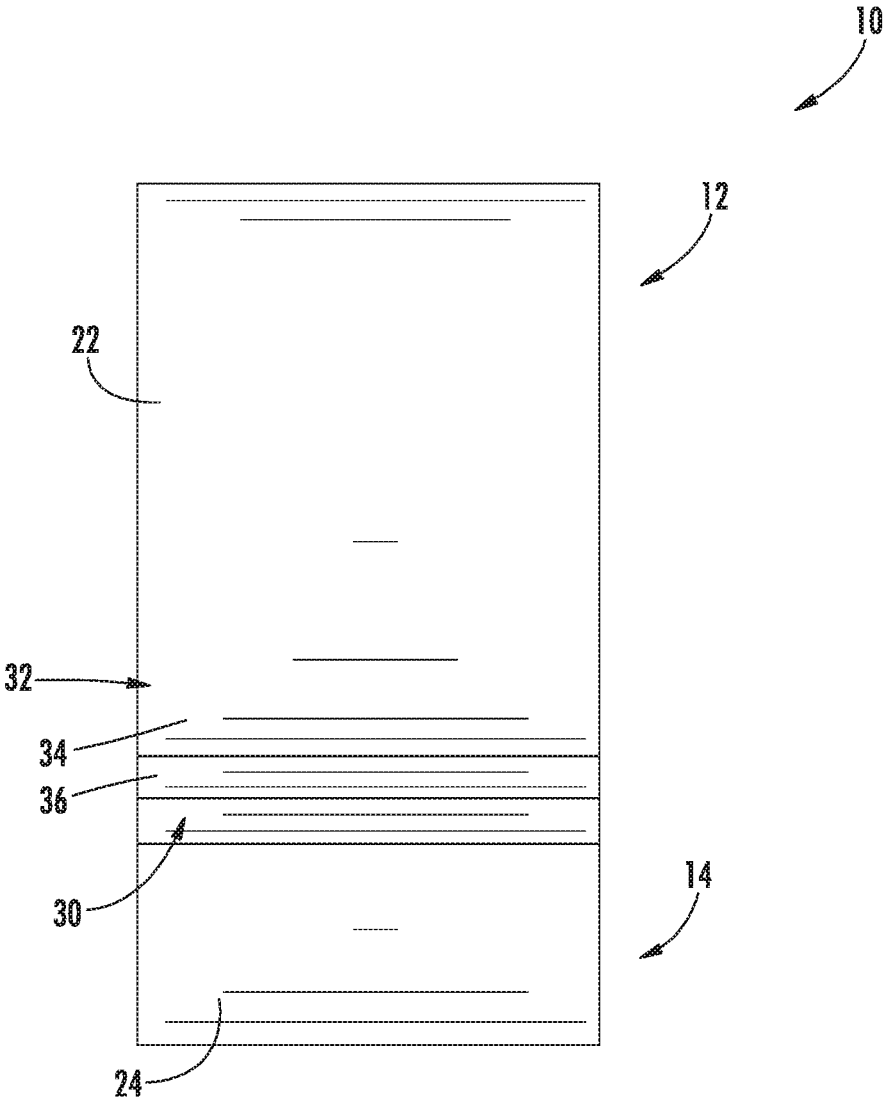
FIG. 3 is a side view of a grounding connector in accordance with embodiments of the present disclosure.

Referring now to FIGS. 1 through 3, embodiments of grounding connectors 10 in accordance with embodiments of the present disclosure are provided. A grounding connector 10 in accordance with the present disclosure includes a first body member 12 and a second body member 14. In exemplary embodiments, such grounding connector 10 consists of the first and second body members 12, 14, such that no other separate components are provided which form the grounding connector 10. Further, in exemplary embodiments, the first and second body members 12, 14 may be interchangeable, thus facilitating cheaper and more efficient manufacturing and also reducing the risk of fit and alignment issues when the first and second body members 12, 14 are assembled together and thus connected to form the grounding connector 10. Alternatively, however, the first and second body members 12, 14 need not be interchangeable, and each may instead include unique features, shapes, etc. which prevent the first and second body members 12, 14 from being substituted in place of one another in a grounding connector 10.

In exemplary embodiments, the first and second body members 12, 14 are each formed from a metal, such as copper, steel, etc. Alternatively, other suitable materials, and in particular other suitable conductive materials, may be utilized.

As shown, the first and second body members 12, 14 which connected together form a plurality of passages 16 therebetween. Passages 16 generally extend through the grounding connector 10, such that openings to the passages are defined in the front and rear faces of the grounding connector 10. In exemplary embodiments, the passages 16 are generally cylindrical, although other suitable shapes may be utilized. In operation, electrical conductors are inserted through and held within the passages 16. After insertion of the electrical conductors into the passages 16, the grounding conductor 10 (and first and second body members 12, 14 thereof) may be crimped or swaged to secure the electrical conductors within and to the grounding connector 10.

In exemplary embodiments, the passages 16 are parallel to each other. Further, in exemplary embodiments, only two passages 16 are provided. In these embodiments, the grounding connector 10 may be characterized as a split parallel grounding connector. However, other suitable orientations and/or numbers of passages 16 may be utilized.

The passages 16 may be formed by troughs 18, 20 defined in one or both of the first body member 12 and second body member 14. As shown, first body member 12 includes a plurality of troughs 18 and second body member 14 includes a plurality of troughs 20. In these embodiments, mating troughs 18, 20 each form a passage 16 therebetween when the first and second body members 12, 14 are assembled together. Alternatively, troughs may only be defined in the first body member 12 or second body member 14, or the troughs 18, 20, may not mate, such that the passages 16 are defined by individual troughs of a body member 12, 14 and mating walls of the other body member 12, 14.

Troughs 18, 20 generally extend through the grounding connector 10 (such as the first body member 12 or second body member 14 thereof), such that openings to the troughs 18, 20 are defined in the front and rear faces of the grounding connector 10 (such as the first body member 12 or second body member 14 thereof). In exemplary embodiments, troughs 18 and/or 20 are generally arcuate, although other suitable shapes may be utilized. In exemplary embodiments, the troughs 18 and/or 20 in first body member 18 and/or second body member 20 are parallel to each other. Further, in exemplary embodiments, only two troughs 18 and/or 20 are provided in first body member 18 and/or second body member 20. In these embodiments, the grounding connector 10 may be characterized as a split parallel grounding connector. However, other suitable orientations and/or numbers of troughs 18 and/or 20 may be utilized.

In exemplary embodiments, grounding connectors 10 in accordance with the present disclosure are generally cylindrical. Accordingly, the first body member 12 and second body member 14 may each have a generally arcuate outer surface 22, 24. When the first and second body members 12, 14 are assembled together and thus connected, the generally cylindrical shape of the grounding connector 10 may be formed by such outer surfaces 22, 24.

Further, in some embodiments, one or more exterior cutouts 26, 28 may be defined in the grounding connector 10, such as in the first body member 12 and/or second body member 14. For example, as shown an exterior cutout 26 may be defined in the first body member 12, and an exterior cutout 28 may be defined in the second body member 14. The cutouts advantageously reduce the weight of and amount of material utilized to form the grounding connector 10, such that less force is required for plastic deformation during crimping, swaging, etc. Further, the cutouts advantageously allow for additional compression of the grounding connector 10, thus increasing the range of conductor sizes which the grounding connector 10 can accommodate.

Each of the first body member 12 and second body member 14 may further include at least one of a locking channel 30 or a locking tab 32. In some embodiments, one of the first body member 12 or second body member 14 may include multiple locking channels 30 while the other of the first body member 12 or second body member 14 includes multiple locking tabs 32. Alternatively, in exemplary embodiments as shown, each of the first body member 12 and the second body member 14 includes a locking channel 30 and a locking tab 32.

A locking tab 32 of the first body member 12 or second body member 14 is generally insertable into a locking channel 30 of the other of the first body member 12 or second body member 14. Such insertion such that the locking tab 32 is disposed within the locking channel 30 may occur when the first body member 12 and the second body member 14 are assembled together, and may secure the connection between the first body member 12 and second body member 14.

For example, in the embodiments shown, the locking tab 32 of the first body member 12 is disposed in the locking channel 30 of the second body member 14 and the locking tab 32 of the second body member 14 is disposed in the locking channel 30 of the first body member 12 when the first and second body members 12, 14 are assembled together, thus connecting the first and second body members 12.

As shown, a locking tab 32 may include a portion of the outer surface 22, 24 of the first body member 12 or second body member 14. A locking tab 32 may, for example, include an arcuate arm 34 which includes the portion of the outer surface 22, 24. Further, a locking tab 32 may include an inward-facing tip 36 which extends from the outer arm 34 inwardly away from the subject portion of the outer surface 22, 24.

A mating locking channel 30 may have a complementary shape to the locking tab 32, such that the locking tab 32 is easily insertable into the locking channel 30.

The use of such locking tabs 32 advantageously eliminates the need for extraneous/additional components that need to be assembled onto the grounding connector 10 to secure the electrical conductors therein. Assembly is thus easier and more efficient, and concerns regarding dropping and losing such components are eliminated.

In some embodiments, each of the first and second body members 12, 14 may include an internal step 40, 42. The internal steps 40, 42 may be defined by the internal surfaces of the first and second body members 12, 14. As shown, the internal step 40, 42 of each of the first and second body members 12, 14 may for example be disposed between troughs 18, 20 of the plurality of troughs 18, 20 of the respective first and second body members 12, 14. For example, internal step 40 is shown between troughs 18 of the first body member 12, and internal step 42 is shown between troughs 20 of the second body member 14. In exemplary embodiments the internal steps 40, 42 mate together in contact with one another when the first and second body members 12, 14 are assembled together and thus connected. Such mating together advantageous orients the first and second body members 12, 14 relative to each other when connected.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A grounding connector connectable to first and second electrical conductors, the grounding connector comprising:

a first body member and a second body member, each of the first and second body members defining a plurality of troughs, each of the first and second body members further comprising a locking channel and a locking tab, wherein mating troughs of the first and second body members together form passages which extend through the grounding connector when the first and second body members are assembled together, and wherein the locking tab of the first body member is disposed in the locking channel of the second body member and the locking tab of the second body member is disposed in the locking channel of the first body member when the first and second body members are assembled together, and wherein the locking tab of each of the first and second body members comprises an arcuate arm and an inward-facing tip extending from the arm, and wherein the first body member and the second body member each further comprises an internal step, the internal step of each of the first body member and the second body member extending from an internal surface disposed between troughs of the plurality of troughs of the respective first body member and second body member, wherein the internal step of the first body member contacts the internal surface of the second body member and mates with the internal step of the second body member, and wherein the internal step of the second body member contacts the internal surface of the first body member and mates with the internal step of the first body member, when the first and second body members are assembled together.

2. The grounding connector of claim 1, wherein the plurality of troughs of each of the first and second body members are parallel to each other.

3. The grounding connector of claim 1, wherein each of the first and second body members has two parallel troughs.

4. The grounding connector of claim 1, wherein the first and second body members are interchangeable.

5. The grounding connector of claim 1, wherein the grounding connector consists of the first body member and the second body member.

6. The grounding connector of claim 1, wherein the first body member and the second body member are each formed from a metal.

7. The grounding connector of claim 1, wherein the grounding connector has a generally cylindrical shape with a generally circular cross-sectional profile when the first and second body members are assembled together.

8. The grounding connector of claim 1, herein an outer surface of each of the first and second body members is generally arcuate.

9. The grounding connector of claim 8, wherein an exterior cutout is defined in each of the first and second body members.

10. A grounding connector connectable to first and second electrical conductors, the grounding connector comprising:

a first body member and a second body member, each of the first and second body members connectable together to form a plurality of passages therebetween, one of the first or second body members further comprising one of a locking channel or a locking tab and the other of the first or second body members further comprising the other of a locking channel or a locking tab, wherein the locking tab is disposed in the locking channel when the first and second body members are assembled together, and wherein the locking tab comprises an arcuate arm and an inward-facing tip extending from the arm, wherein the first body member and the second body member each further comprises an internal step, the internal step of each of the first body member and the second body member extending from an internal surface disposed between passages of the plurality of passages, wherein the internal step of the first body member contacts the internal surface of the second body member and mates with the internal step of the second body member, and wherein the internal step of the second body member contacts the internal surface of the first body member and mates with the internal step of the first body member, when the first and second body members are assembled together.

11. The grounding connector of claim 10, wherein mating troughs of the first and second body members together form the passages.

12. The grounding connector of claim 10, wherein the plurality of passages are parallel to each other.

13. The grounding connector of claim 10, wherein each of the first and second body members comprises a locking channel and a locking tab, and wherein the locking tab of the first body member is disposed in the locking channel of the second body member and the locking tab of the second body member is disposed in the locking channel of the first body member when the first and second body members are assembled together.

14. The grounding connector of claim 10, wherein the first and second body members are interchangeable.

15. The grounding connector of claim 10, wherein an outer surface of each of the first and second body members is generally arcuate.

16. The grounding connector of claim 10, wherein the grounding connector consists of the first body member and the second body member.

17. The grounding connector of claim 10, wherein the grounding connector has a generally cylindrical shape with a generally circular cross-sectional profile when the first and second body members are assembled together.

* * * * *